US006461403B1

(12) United States Patent
Olsen

(10) Patent No.: US 6,461,403 B1
(45) Date of Patent: Oct. 8, 2002

(54) APPARATUS AND METHOD FOR THE FORMATION OF UNIFORM SPHERICAL PARTICLES

(75) Inventor: Kristian P. Olsen, Edmonton (CA)

(73) Assignee: Alberta Research Council Inc., Alberta (CA)

( * ) Notice: Subject to any disclaimer, the term of this patent is extended or adjusted under 35 U.S.C. 154(b) by 0 days.

(21) Appl. No.: 09/698,271

(22) Filed: Oct. 30, 2000

Related U.S. Application Data

(63) Continuation-in-part of application No. 09/255,862, filed on Feb. 23, 1999, now Pat. No. 6,162,377.

(51) Int. Cl.[7] ..... B22F 9/08

(52) U.S. Cl. ..... 75/335; 75/338; 75/340; 264/9; 264/12

(58) Field of Search ..... 75/331, 334, 335, 75/338, 340; 364/9, 12, 14

(56) References Cited

U.S. PATENT DOCUMENTS

| | | | | |
|---|---|---|---|---|
| 4,035,116 A | | 7/1977 | O'Brien et al. | 425/10 |
| 4,259,270 A | * | 3/1981 | Winter et al. | 75/334 |
| 4,801,411 A | | 1/1989 | Wellinghoff et al. | 264/7 |
| 4,871,489 A | | 10/1989 | Kethcam | 264/9 |
| 4,935,173 A | | 6/1990 | Huey et al. | 264/14 |
| 4,966,737 A | * | 10/1990 | Werner et al. | 75/338 |
| 5,520,715 A | * | 5/1996 | Oeftering | 75/335 |
| 6,162,377 A | * | 12/2000 | Ghosh et al. | 264/9 |

FOREIGN PATENT DOCUMENTS

| | | | | |
|---|---|---|---|---|
| EP | 0 361 396 A1 | | 4/1990 | B22F/9/08 |
| GB | 1307553 | | 2/1973 | B22D/23/08 |
| GB | 2 240 553 A | | 7/1991 | B22F/9/08 |
| JP | 62-238306 | * | 10/1987 | 75/331 |

* cited by examiner

*Primary Examiner*—George Wyszomierski
(74) *Attorney, Agent, or Firm*—Freedman & Associates

(57) ABSTRACT

The present invention relates to an apparatus and method for the formation of nearly spherical particles, particularly for the formation of metal or metal alloy particles with an induced duplex microstructure. The present invention provides an atomization apparatus having a nozzle positioned at the bottom of a cooling chamber. Rayleigh wave instability may be induced by imparting vibrations to a stream of molten material, which is released under positive pressure upward into a cooling chamber where the stream breaks up into substantially spherical droplets. This produces a plurality of uniform droplets, each droplet having an initial velocity sufficient to follow a unique upward parabolic trajectory above the aperture. These parabolic trajectories carry the individual droplets to a chill body disposed within the cooling chamber, with which they impact while they are at least partially molten.

33 Claims, 8 Drawing Sheets

APPARATUS AND METHOD FOR THE FORMATION OF UNIFORM SPHERICAL PARTICLES

This application is a continuation-in-part of U.S. patent application Ser. No. 09/255,862 filed Feb. 23, 1999, U.S. Pat. No. 6,162,377.

FIELD OF THE INVENTION

The present invention relates to an apparatus and method for atomizing a molten liquid to form particles of substantially uniform size, particularly for the formation of relatively large metal particles of substantially uniform size with an induced duplex microstructure.

DESCRIPTION OF THE PRIOR ART

Spherical particles, and in particular spherical particles of one of a metal and a metal alloy, have increasing applications in industrial processes. Spherical particles provide good flowability, low surface area and hence a minimum of surface oxide, and efficient packing. Applications for relatively large spherical particles, approximately 200 microns to 5 mm, of uniform size, such as Thixomolding™ of alloys, and other applications in ceramics, ceramic metal combinations, metals and metal alloys provide a demand which is presently not fully satisfied. Unfortunately, current practices for the formation of large particles of at least nearly spherical shape are expensive, and do not provide the level of shape, uniformity and purity demanded.

A common prior art practice for the formation of at least nearly spherical particles is disclosed in U.S. Pat. No. 4,428,894 issued to Bienvenu in 1984 in the name of Extramet. A jet of molten metal is passed through a vibrating orifice to produce a cylindrical stream of the molten metal. A cylindrical stream of such a molten metal is inherently unstable, its surface becoming increasingly perturbed as it issues from the nozzle until at some distance the stream spontaneously breaks up into separate droplets. The high surface tension of the molten metal causes the droplets to immediately assume at least a nearly spherical shape, which minimizes the surface free energy of the droplets. The spherical droplets fall from the orifice under the influence of gravity through an inert gas atmosphere contained in a cooling tower. If, however, particles larger than one millimeter in diameter are to solidify to a point where sphericity is maintained after impacting the bottom of the cooling tower, an extremely tall cooling tower is required. This cooling tower method also causes the droplets to pass through the inert atmosphere at high relative velocity, up to at least approximately 20 meters per second. High relative velocity, it has been found, distorts the spherical shape of the droplets. In addition impact with the chamber walls prior to solidification, or impact with the bottom of the cooling tower if a quench liquid is not used, flattens the particles unless the cooling tower is sufficiently tall. When quench liquids are used to remove significant latent heat, droplets that are still liquid or semi-solid can lose their spherical shape upon impact with the quench liquid. Thus even with a quench liquid, residence time in a cooling tower must still be maximized in order to permit droplets to cool sufficiently to reduce deformation.

Other factors that adversely affect particle shape include agglomeration with other droplets prior to solidification, which affects the shape and size distribution of particles. Since the individual droplets produced by the breakup of a liquid stream are irregularly shaped, a particular problem in the case of high melting point materials is that solidification can occur prior to spheroidization of the droplets, resulting in the production of irregularly shaped particles. A further problem is associated with surface oxidation. Oxides normally have a much higher melting point, and for skin-forming alloys like aluminum, this layer forms almost immediately and can make spheroidization impossible. Of course oxidation can be reduced by providing an inert gas atmosphere within the cooling tower. A drawback to this method is that since a cooling tower can be 20 meters high, circulating a cooling inert atmosphere throughout is quite expensive.

U.S. Pat. No. 4,871,489 by Ketcham, issued to Corning Incorporated in 1989, discloses the use of an inverted apparatus produced by Thermo Systems Incorporated for the production of metal oxide precursors. This apparatus is designed for the production of very fine particles, having a diameter of about 8.5 microns and not larger than 50 microns. Fluid is forced though a thin perforated plate to form a plurality of fluid streams. Oscillation of the plate is applied in the direction of the fluid flow to break up uniform droplets. The droplets are entrained in the flow of a dispersion medium, which cools and removes the light particles. However, this device is not adequate for the formation of larger particles, which have greater latent heat and kinetic energy. Sufficient cooling would not occur as particles are entrained in the dispersion fluid. The flow of dispersion fluid necessary would be rapid to lift the heavy particles from the chamber, which would adversely affect the particle shape. In addition, the greater latent heat and longer cooling time would lead to increased particle agglomeration as still molten particles contact one another in the dispersion flow. U.S. Pat. No. 4,871,489 does not teach a method for increasing the residence time for the solidification of large spherical particles.

While the prior art methods are adequate for their intended purpose of producing at least nearly spherical particles of substantially uniform size, they do not allow for any variation of the microstructure that develops during particle cooling. The particles that are typically produced by spin casting techniques are other than single crystals, and normally display some sort of grain microstructure. Often the grain microstructure of the particles is a combination of irregular "cells" and dendrites. It would be advantageous to provide a method for producing metallic particles of substantially uniform size with a desired microstructure, such as for example an induced duplex microstructure. A duplex microstructure could be produced with a pure metal, for instance magnesium or aluminum, where solidification of the droplet occurs at a single temperature. Alternatively, solidification of metal alloy particles occurs over a range of temperatures. Significantly, the particular microstructure of metallic particles dramatically affects the properties of the particles, especially when the particles are subjected to thermal treatment, or even re-melted, subsequent to their fabrication. For instance, the finer grains typically melt earlier than the larger grains, which would allow for the preservation of chemical composition and relative size of the larger grains.

OBJECT OF THE INVENTION

In order to overcome these and other limitations of the prior art, it is an object of the invention to provide a method and an apparatus for producing nearly spherical particles with an induced duplex microstructure from a jet of a molten material in an inverted stream atomization apparatus.

SUMMARY OF THE INVENTION

It is proposed to provide an inverted cooling chamber that releases a molten stream at or near the bottom to launch large particles on a parabolic trajectory having an upward and downward path. This provides a longer cooling time in a controlled atmosphere at low relative velocity without the large cooling tower currently required by the prior art. Advantageously, the lower maximum velocities that are achieved by the particles in an inverted cooling chamber allows for formation of nearly-spherical particles against a chill body for receiving the still partially molten droplets to be disposed within the particle trajectory, causing the particles to solidify rapidly with an induced duplex microstructure upon impacting the chill body.

In accordance with an embodiment of the current invention, there is provided a method of forming particles of substantially uniform size with an induced duplex microstructure in an atomization apparatus comprising the steps of: releasing a stream of molten material through an aperture under positive pressure upward into a cooling chamber where the stream breaks up into substantially spherical droplets having a kinetic energy sufficient to follow an upward trajectory above the aperture; and, allowing the droplets to impact a chill body disposed within a collection area of the cooling chamber while the droplets are at least partially molten.

In accordance with another embodiment of the current invention, there is provided a method of forming particles of inhomogeneous chemical composition and of substantially uniform size with an induced duplex microstructure in an atomization apparatus comprising the steps of: releasing a stream of molten material through an aperture under positive pressure upward into a cooling chamber where the stream breaks up into substantially spherical droplets having a kinetic energy sufficient to follow an upward trajectory above the aperture, the molten material provided to the aperture within a range of temperatures between approximately the liquidus point and the solidus point of the molten material; and, allowing the droplets to impact a chill body disposed within a collection area of the cooling chamber while the droplets are at least partially molten.

In accordance with still another embodiment of the current invention, there is provided an atomization apparatus for forming particles of substantially uniform size with an induced duplex microstructure in an atomization apparatus comprising: a vessel for containing a material at a molten state; pressurization means for applying positive pressure to at least a portion of the molten material in the vessel; a cooling chamber; at least one aperture contained in the cooling chamber communicating with the vessel for releasing a stream of the molten material under pressure upwards into the cooling chamber to break the stream up into nearly spherical droplets; at least an orifice for introducing a plume of vapor and gas coolant to impinge on the molten stream; and, a chill body disposed within a collection area of the cooling chamber for receiving the at least partially molten droplets and for providing a quench surface to rapidly solidify rapidly the at least partially molten droplets, whereby the cooling chamber further includes a top above the at least one aperture dimensioned to permit each of the droplets released to follow at least an upward path of a parabolic trajectory.

BRIEF DESCRIPTION OF THE DRAWINGS

Like numerals are used throughout to indicate like elements.

DETAILED DESCRIPTION OF THE INVENTION

Figure 1:
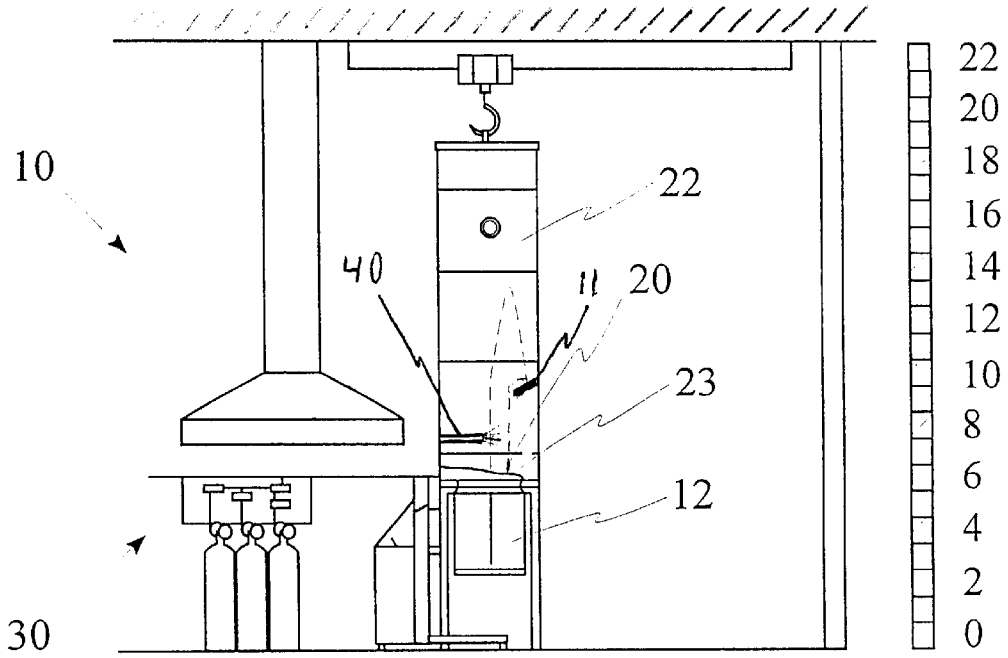
FIG. 1 is a schematic illustration of an inverted stream apparatus for the production of solid particles from molten materials, in accordance with the present invention.
Figure 4:
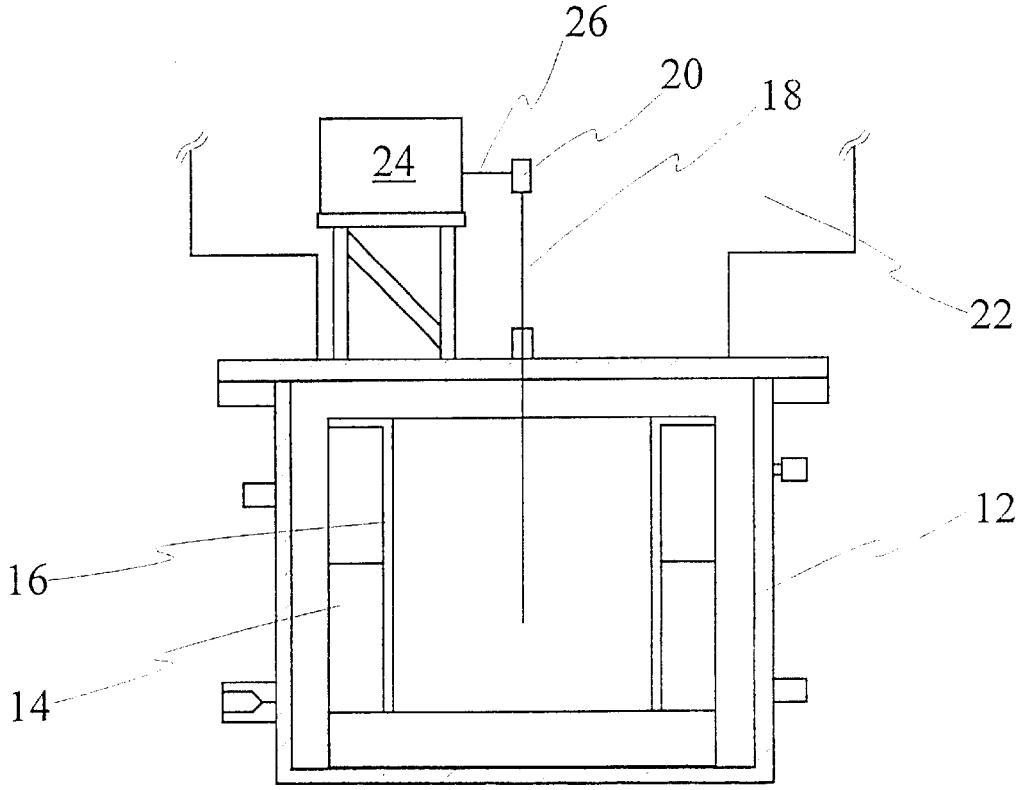
FIG. 4 is a schematic illustration of the containment vessel of the apparatus of FIG. 1 shown in greater detail.

Referring to FIG. 1 an apparatus in accordance with the present invention is shown generally at 10. A containment vessel 12, which is also seen more clearly in FIG. 4, surrounds a furnace 14 and a central crucible 16. The crucible 16 is charged with a solid material, for example a metal such as one of aluminum, magnesium and zinc. The furnace 14 heats the crucible 16 until the solid metal contained therein undergoes a change of phase to its molten or liquid state. Molten metal contained within the crucible 16 is held under pressure between approximately 20 kPa and 1000 kPa. For example, an inert gas may be pumped into the containment vessel 12 to achieve the required pressure, or an accumulator may be used to pressurize only a small volume of molten metal at a time. Of course, other pressurization techniques known in the art may also be used. The molten metal under pressure is allowed to pass through a transfer tube 18 to a capillary nozzle 20, wherein each of the nozzle 20 and the transfer tube 18 are heated and insulated to help maintain the metal in its molten state. Filtering of the molten material within the containment vessel may be necessary to prevent the blockage of the nozzle 20 with oxide particles or other impurities. A steel mesh, for example, is positioned over the intake of the transfer tube 18 in the containment vessel 12. Advantageously, molten metal has extremely low viscosity, which greatly facilitates its passage through the transfer tube. The capillary nozzle 20 restricts the flow of the molten metal, which is forced through a narrow diameter aperture 21 of the nozzle 20 at very high speed to form a jet. The jet, specifically a fine cylindrical stream of the molten metal, is launched upward from the nozzle 20 along a predetermined trajectory through a cooling chamber 22 and terminating at a chill body 11 disposed within a collection area 23.

A cylindrical stream of molten metal is inherently unstable, its surface becoming increasingly perturbed as it issues from the nozzle 20 until at some distance the stream spontaneously breaks up into separate droplets. The high surface tension of the molten metal causes the droplets to immediately assume at least a nearly spherical shape, which minimizes the surface free energy of the droplets. Vibration applied to the nozzle 20 by a vibration unit 24 causes a Rayleigh wave disturbance to assist the break up of the molten stream into discrete droplets or particles of at least substantially uniform size. In addition, oscillation of the nozzle 20 occurs in a transverse direction to the direction of the molten stream, laterally displacing the nozzle 20 and causing sequential droplets to leave the nozzle 20 on different trajectories. Conveniently vibration from the vibration unit 24 can impart wave disturbance and oscillation to the nozzle 20 simultaneously.

Figure 5:
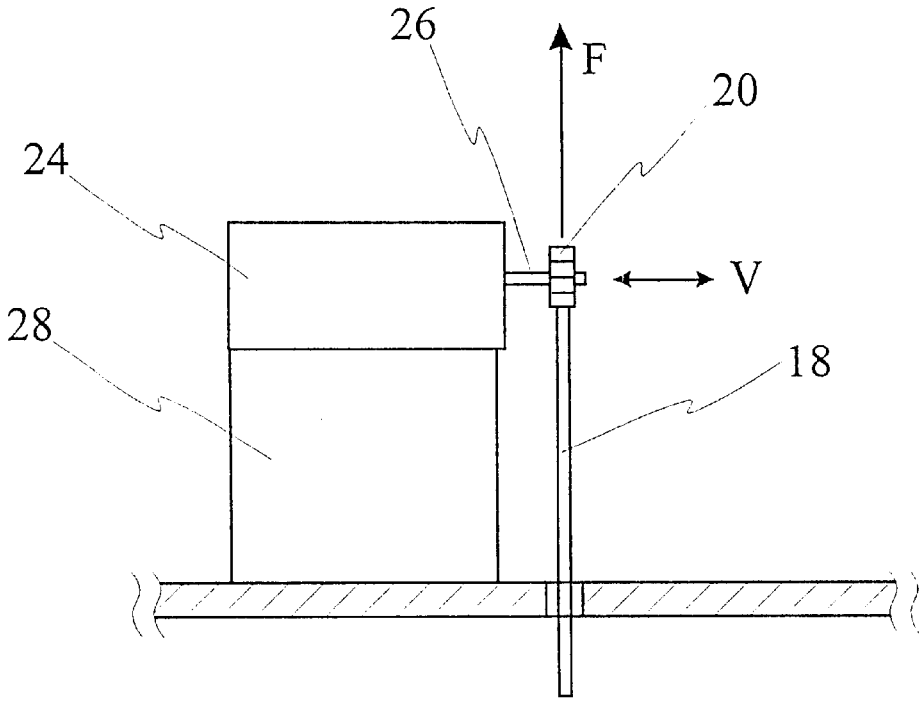
FIG. 5 is a schematic illustration of a single orifice nozzle of the apparatus of FIG. 1, shown in greater detail.

Referring to FIG. 5, a nozzle and vibration unit in accordance with the present invention is shown wherein the stream of molten metal is depicted at arrow F and the oscillation is depicted at arrow V. Vibration unit 24, which is mounted on a support 28 above the containment vessel 12 to dampen unwanted transmission of vibrations, includes an acoustic vibration transducer such as a speaker coil for providing controlled frequency and amplitude vibration through a physical connection such as a connecting rod 26 to the nozzle 20. This connection imparts an oscillation of the nozzle 20 transverse to the direction of flow of the molten stream. Transverse oscillation of the nozzle 20 creates a liquid stream that retains a controllable trajectory profile, even after breakup into droplets. This is beneficial whether or not Rayleigh wave instability is induced. The fluid stream is released from continuously changing positions, launching sequential droplets on different trajectories. This helps prevent droplets colliding or coalescing. Control of the rate of oscillation and displacement of the nozzle through modulation of the amplitude can ensure that each droplet within a critical time period in a cooling chamber travels on a unique parabolic trajectory. When a droplet exhibits a unique trajectory relative to its neighbors, the probability of inter-particle collisions is reduced. Avoiding inter-particle collisions is important in obtaining uniform particles. Of course, other means are known which could be used for imparting wave disturbance to the fluid stream, such as to the surrounding gas, or to the molten fluid. Also other means are known which could be used for separating droplet trajectories to prevent agglomeration or collision, such as applying a charge to the droplets, or by directing the droplets with a dispersing flow. Conveniently, the transverse vibrations provide both a means for disrupting the fluid stream into uniform droplets and means for separating or dispersing trajectories of sequential droplets from a single nozzle 20.

Figure 6:
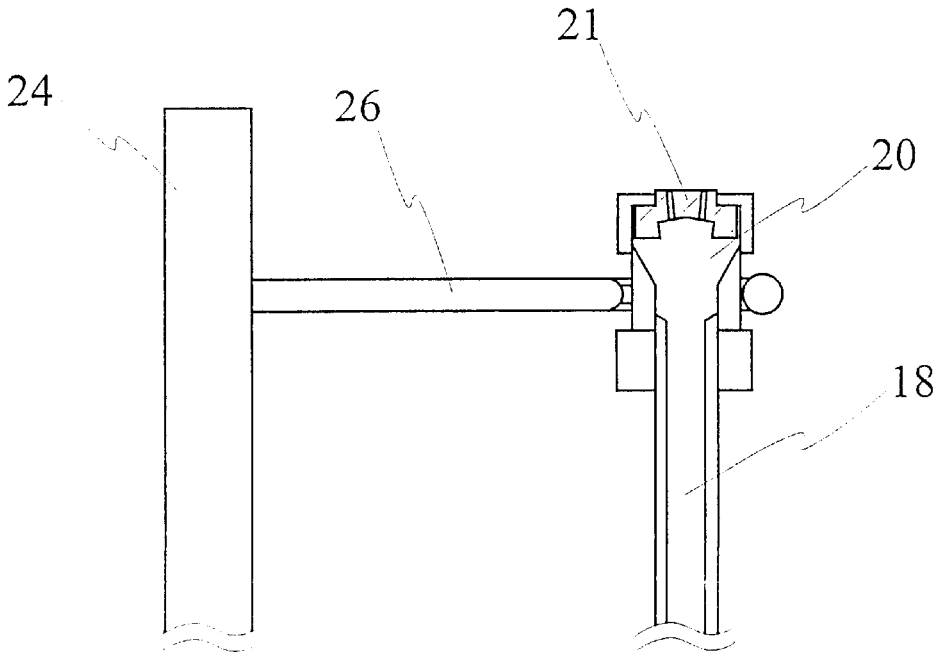
FIG. 6 is a schematic illustration of a dual orifice nozzle.

The configuration of the nozzle 20 may include a single aperture 21 or alternatively the configuration of the nozzle 20 may include a plurality of apertures, such as would be the case for a dual orifice nozzle shown in detail in FIG. 6. The one or more apertures 21 may be in the form of an orifice or a capillary. Referring now to FIG. 5 and to FIG. 6, each aperture 21 in the nozzle 20 is oriented at a small angle to the vertical for launching the droplets on a parabolic trajectory toward a collecting area 23 at the bottom of the cooling chamber 22 a distance from the nozzle 20. Launching droplets along parabolic trajectories reduces the occurrence of collisions between droplets moving along ascending and descending paths of their trajectories. An angle of approximately as small as 5 degrees from vertical or as large as 45 degrees from vertical is anticipated, whereby the angle is constrained by the maximum horizontal travel accommodated within the cooling chamber 22. Further, apertures 21 must be arranged, for instance as illustrated in FIG. 6, on opposite sides of the nozzle 20, to prevent the oscillation from causing collision between trajectories of droplets from the plural apertures 21.

For the formation of at least nearly spherical particles of substantially uniform size, the pressure of the molten fluid is controlled to select a desired trajectory height for the droplets before the return fall, such that the trajectory provides sufficient residence time for the droplets to form a skin solid enough to retain their shape during the fall and impact at the collection area 23. To maximize cooling time in the cooling chamber 22, the collection area is usually at a level with the nozzle 20 or below the nozzle 20. However, a collection area 23 could be at a higher level within the cooling chamber to take advantage of the low kinetic energy of the descending droplets.

The droplets follow a predetermined parabolic trajectory 35 through a controlled atmosphere that is maintained within the cooling chamber 22 by a gas control system shown generally in FIG. 1 at 30. The controlled atmosphere circulated by the gas control system 30 also helps to maintain a constant temperature for the removal of latent heat from, and the concomitant solidification of, the particles in flight. Alternatively, the atmospheric circulation may comprise a cooling counter flow from the top of the cooling chamber 22, thus providing a cooling temperature gradient for particle solidification. Additionally, a vacuum pump and release valve may be incorporated to maintain a constant pressure and constant coolant flow within the cooling chamber 22.

In the absence of substantial surface oxidation, particles of at least a nearly spherical shape and substantially uniform size are obtained. The size of the particles formed is dependent upon the aperture diameter in the nozzle 20 and the frequency of the imparted vibrations. Advantageously, a plume of argon vapor is introduced to provide significant cooling without disrupting the particle formation. As illustrated in FIG. 1, the argon plume is delivered by the orifice 40 to impinge transversely on the molten stream below the trajectory azimuth. The angle of the coolant plume against the molten stream can be modified. The plume impinges on the stream where it is still stable and therefore does not affect the stream instability or the formation of the particle shape. This provides effective cooling without affecting the droplet shape. This is unlike prior art gas flow atomization techniques, where gas flow induces atomization but the high relative velocity disrupts particle shape. For instance, evaporation of argon from the liquid phase, which is sprayed into the cooling chamber at −186 degrees C., absorbs significant latent heat while simultaneously introducing a large temperature differential into the cooling chamber to further increase the rate of cooling. As a result, the trajectory height and therefore the cooling chamber height can be further reduced. A positive pressure is maintained within the cooling chamber 22 of approximately 5–15 kPa above atmospheric pressure, which permits an increased volume flow of coolant. Advantageously, the positive pressure of inert gas assists in displacing undesired gases from the cooling chamber that may have been introduced through leaks.

Referring again to FIG. 1 the apparatus for producing flattened spherical particles of substantially uniform size and with an induced duplex microstructure shown generally at 10 further comprises a chill body 11 disposed within the descending portion of the trajectory of the still at least partially molten droplets. Alternatively, the chill body 11 is disposed within the upward trajectory of the stream below the azimuth of the trajectory. The chill body 11 is positioned at a height within the cooling chamber where the droplets formed by the breakup of the molten stream are still partially molten, having had other than sufficient cooling time to form a skin solid enough to retain their shape during the fall and impact at the collection area 23. The droplets are allowed to impact the chill body 11 while they are still at least partially molten to rapidly cool the droplets and generate a plurality of nucleation centers within the bulk of the molten material. A duplex microstructure is created by the use of two cooling regimes. The first causes formation of primary grains whose size is dependent upon the rate of cooling. The second regime causes each droplet to cool much more quickly, and the leftover liquid solidifies into grains that are smaller than the primary ones. Note that for an alloy, the resultant chemical composition of the large, primary grains is often different than the smaller, secondary ones.

Figure 9A:
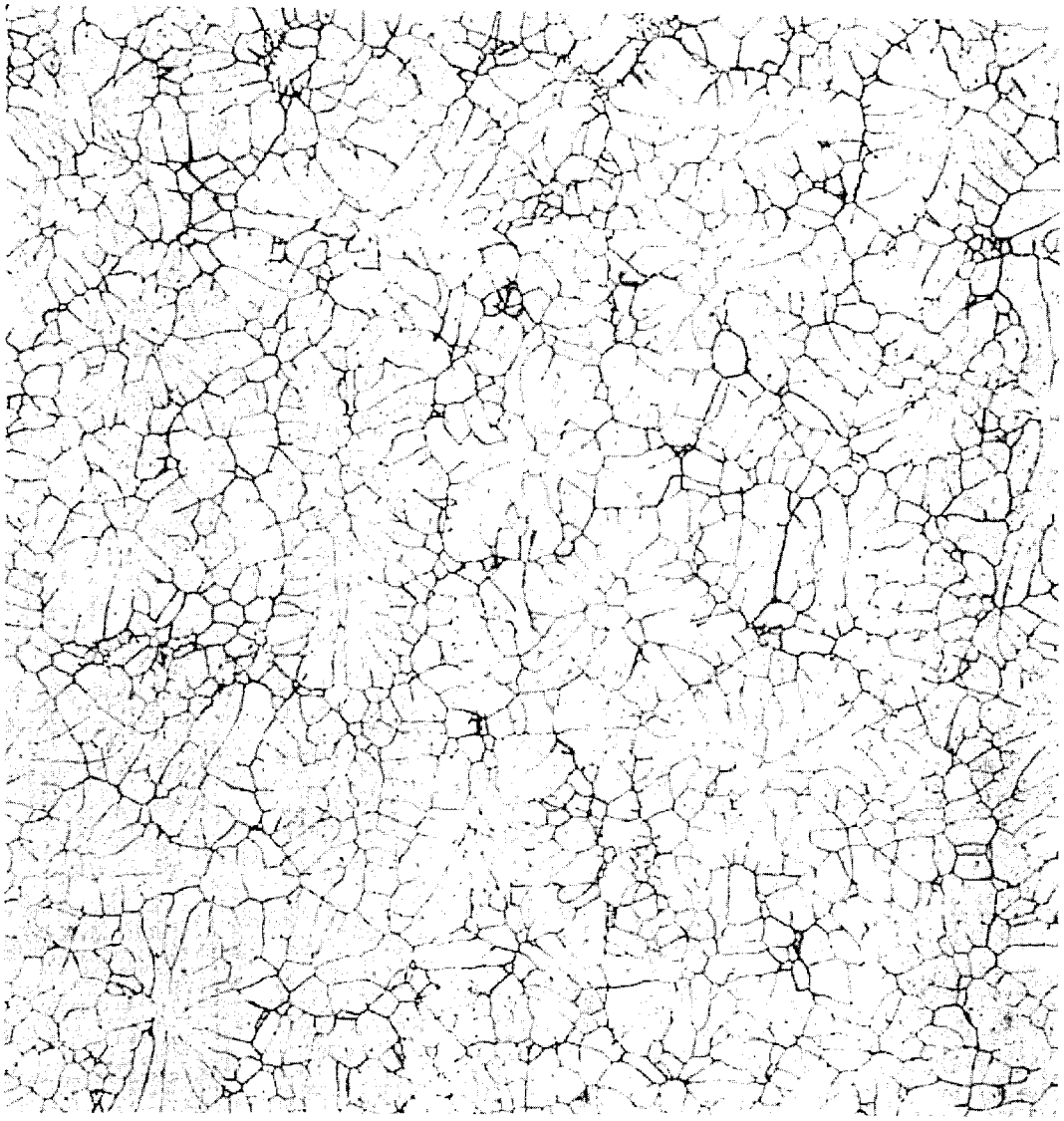
FIG. 9*a* is a micrograph showing a section of a particle displaying a normal microstructure, wherein the particle was substantially solid prior to impacting a surface.
Figure 9B:
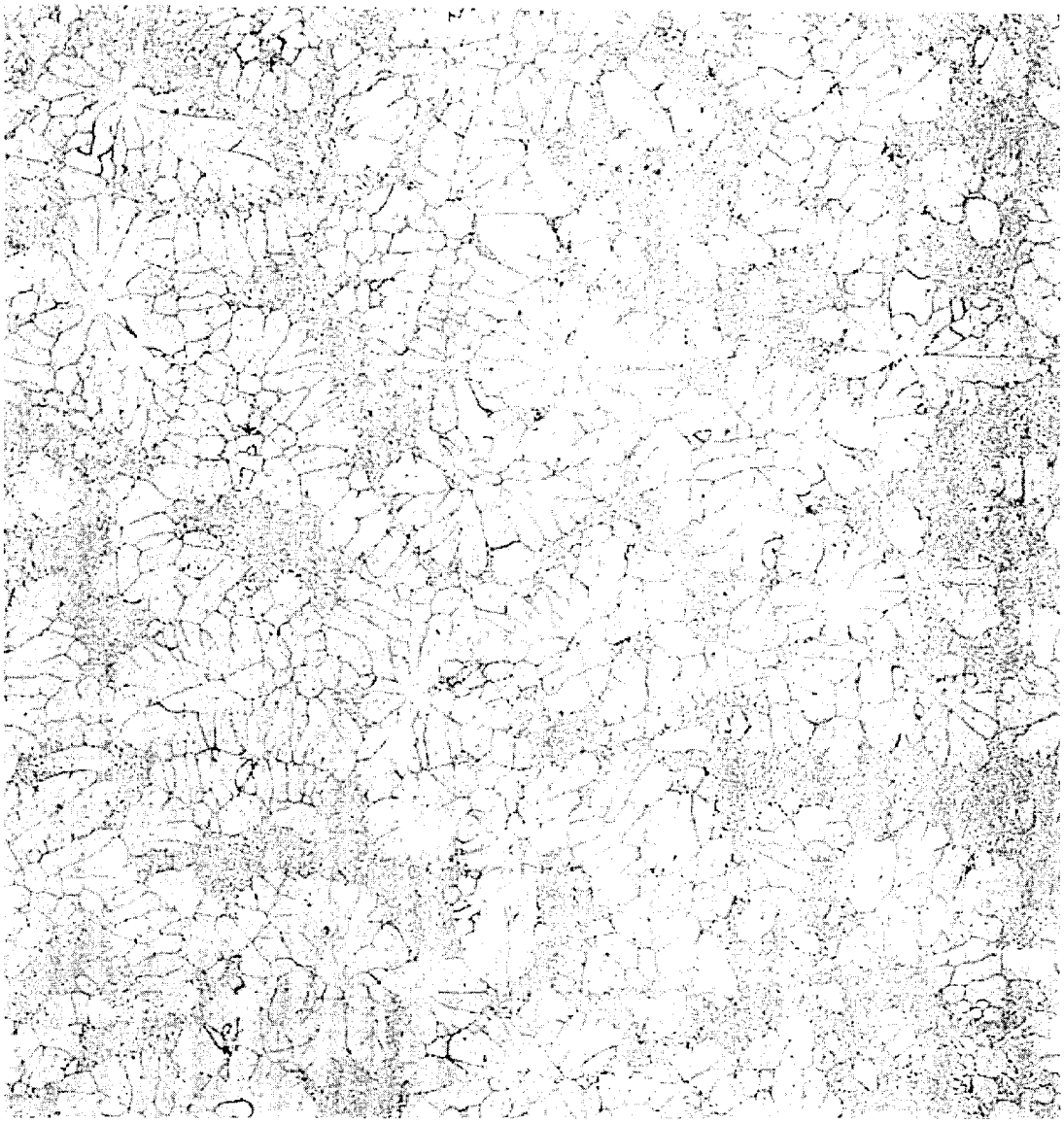
FIG. 9*b* is a micrograph showing a section of a particle displaying an induced duplex microstructure, wherein the particle was substantially molten prior to impacting a surface.

The particles that are typically produced by spin casting techniques are other than single crystals, and such particles normally display some sort of grain microstructure. Referring to FIG. 9*a* a micrograph showing a section of a particle displaying a normal microstructure, wherein the particle was substantially solid prior to impacting a surface, is shown. Often the grain microstructure of such a particle is a combination of irregular "cells" and dendrites. Referring now to FIG. 9*b*, a micrograph showing a section of a particle displaying an induced duplex microstructure, wherein the particle was substantially molten prior to impacting a surface, is shown. The light areas represent the coarser primary grains, whose size is dependent upon the rate of cooling. Surrounding the light areas are regions that appear much darker, representing the leftover liquid that subsequently solidifies into grains that are smaller than the primary ones. Note that for an alloy, the resultant chemical composition of the large, primary grains is often different than the smaller, secondary ones.

Figure 10:
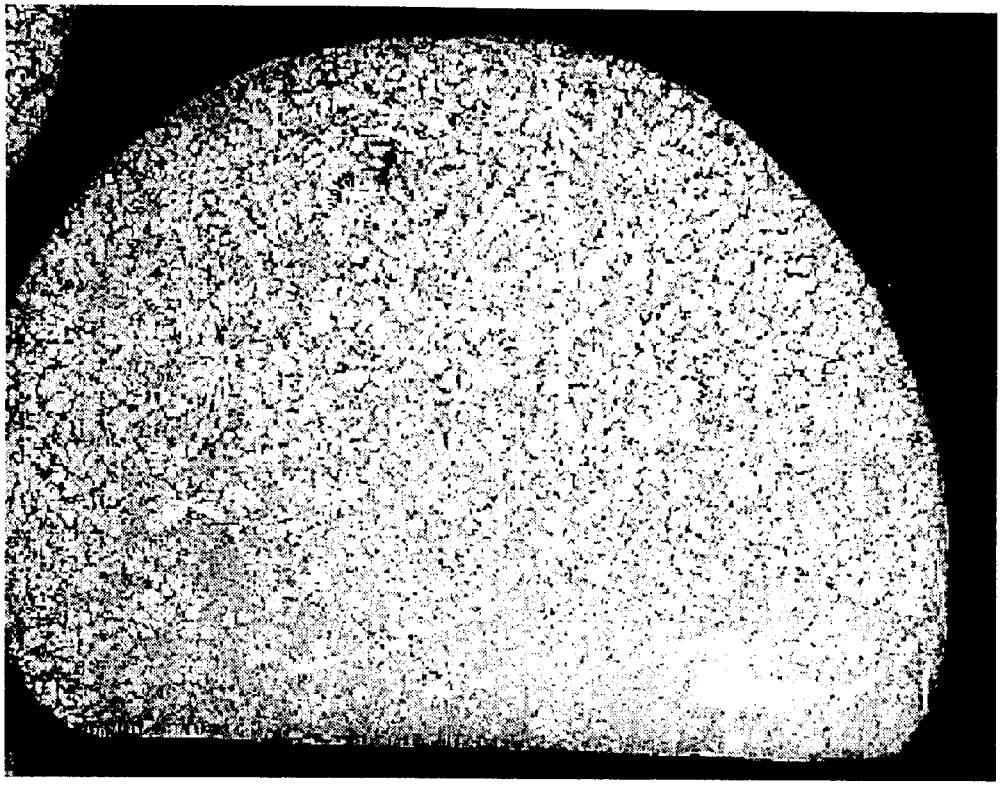
FIG. 10 is a micrograph of a partially flattened particle with an induced duplex microstructure that was obtained in accordance with the present invention.

Referring to FIG. 10, a micrograph of a flattened particle with an induced duplex microstructure produced from a molten stream of an aluminum alloy according to the present invention is shown. The darker patches, representing the finer grains, are more numerous near the flattened surface, which is where the still at least partially molten aluminum alloy droplet made contact with a chill body 11 in the form of a steel plate. Particles having an induced duplex microstructure can be formed in a controlled atmosphere maintained up to at least approximately 100 degrees C. Under such conditions, solidification of the still at least partially molten droplet is rapid. Advantageously, the low relative velocity of the at least partially molten droplets along the parabolic trajectory minimizes the deformation of the nearly spherical droplets when they impinge upon the chill body 11. Additionally, the minimal surface cooling that is experienced by the droplets in the controlled atmosphere during the period of time between the break up of the molten stream into individual droplets and the impact of the droplets with the chill body 11 provides a very thin skin around the particle that further reduces deformation of the nearly spherical droplets. Particles obtained according to the present invention therefore retain a predominantly spherical shape with one substantially flat surface.

Figure 2:
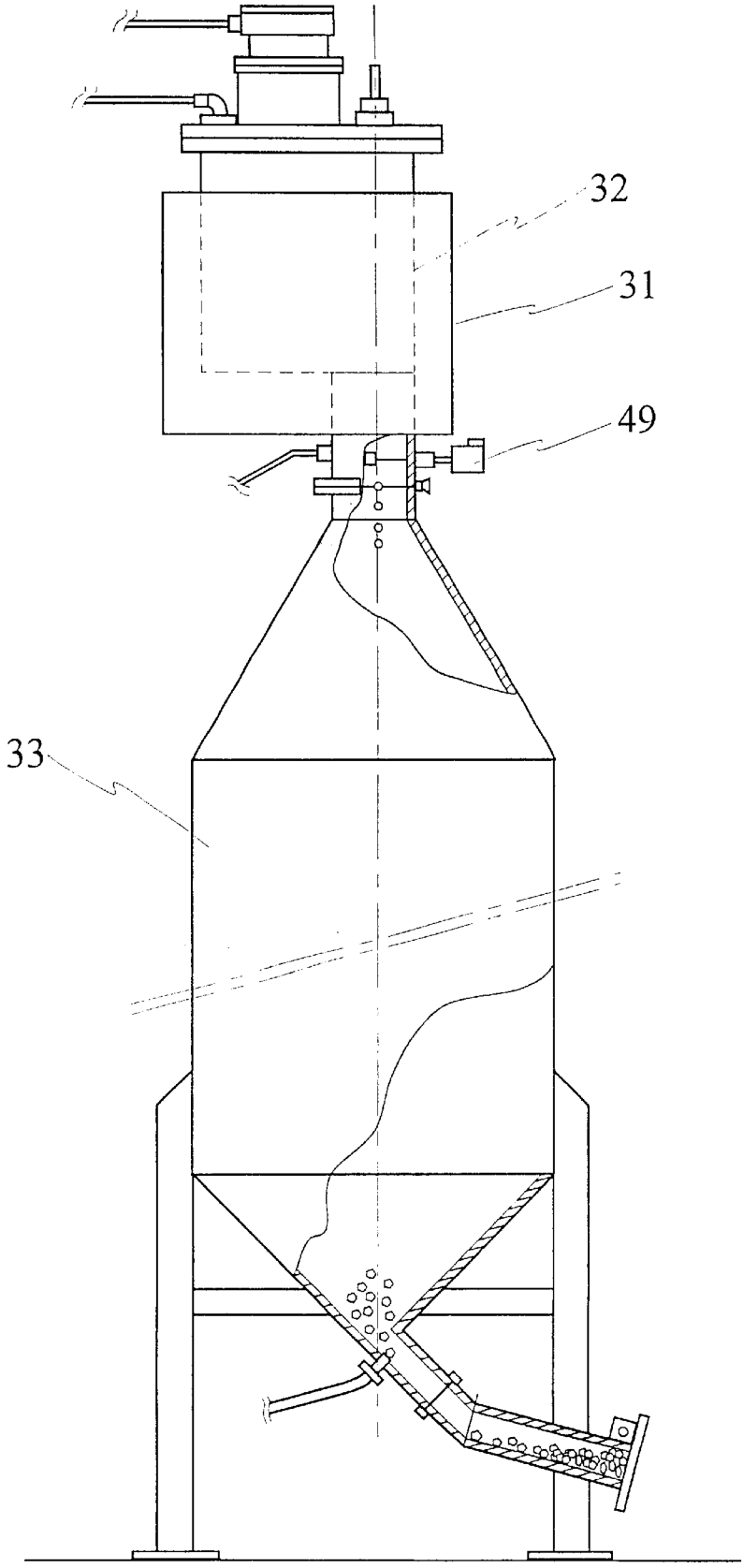
Fig. 2 (Prior Art)
FIG. 2 is a schematic illustration of a prior art cooling tower.

In contrast to the inverted stream apparatus of the present invention that is described above, a typical cooling tower as used in the prior art is shown in FIG. 2. A furnace 31 surrounds a gas-tight cell 32 above a tower 33. A transfer tube provides communication between the cell 32 and the tower 33. A vibrator 49 acts on the tube and causes division of the jet into liquid drops as it passes through the orifice. The drops fall into the tower 33 filled with an inert gas. The height of the tower is sufficient to ensure that the drops of liquid metal solidify while falling. This may be as high as 20 meters.

Figure 3A:
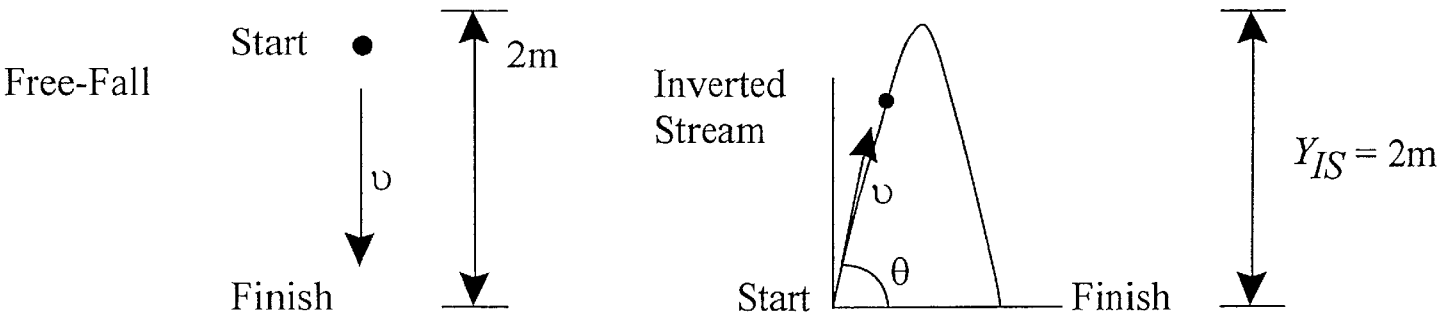
FIG. 3*a* is a graphic illustration of both a gravity freefall trajectory in accordance with the prior art, and an inverted stream trajectory in accordance with the present invention.

Looking at FIG. 3*a* it is possible to compare a frictionless free fall as an approximation of a residence time for a particle to travel within a vertical drop cooling tower.

$$t_{freefall} = \frac{-v_0 - \sqrt{v_0^2 + 2gy}}{g}$$

with $v_0$=6.3 m/s, y=−2 m, and g=−9.81 m/s$^2$, $t_{freefall}$=0.26 seconds.

In the inverted stream case in accordance with the present invention, the equation is as follows:

$$t_{inverted} = \frac{2v_0\sin(\theta)}{g}$$

with θ=88° and $v_0$=6.3 m/s, $t_{inverted}$=1.3 seconds.

This is about 5 times longer than the first equation. Note that the maximum height obtained by the inverted stream, $y_{IS}$ is given by the following equation:

$$y_{IS} = -\frac{(v_0\sin\theta)^2}{2g}$$

given that $v_0$=6.3 m/s and g=−9.81 m/s$^2$ the result is $y_{IS}$=2.0 m.

Figure 3B:
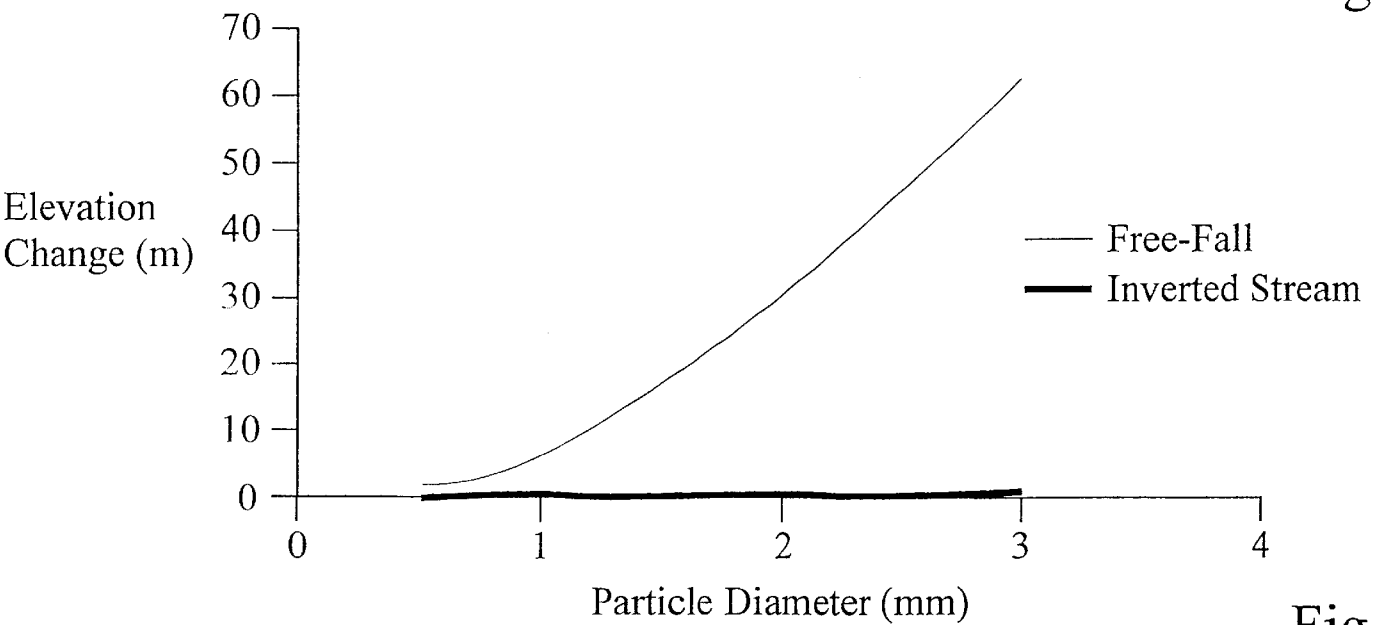
FIG. 3*b* is a graph modeling a minimum cooling tower height for both freefall and inverted stream trajectories.

Therefore with a similar-sized atomization tower, the residence time of a liquid droplet can be greatly increased over a gravity-fed apparatus. The comparison is graphically illustrated in FIG. 3*b* showing the elevation a cooling chamber must accommodate for free fall and inverted stream trajectory in accordance with the present invention, for sufficient cooling to produce granules of desired shape and purity. The model shown in FIG. 3*b* is based upon Newtonian cooling of a magnesium droplet in helium gas. The model incorporates the effects of particle drag, but assumes a constant temperature difference between the droplet and the gas. As can be seen the difference in minimum height can be an order of magnitude with larger particles. Of course, the above comparison assumes that uniform spherical droplets are the desired product, and therefore calculations are based on achieving a droplet residence time through the controlled atmosphere that is sufficient for the droplets to solidify to a point that a spherical shape is retained when the particles impact a surface in the collection area of the cooling chamber. Alternatively, if it is desired that droplets are to impact a chill body 11 while they are only partially solidified, the droplet residence time through the controlled atmosphere must be reduced accordingly, such as for instance by moving the chill body to a position that is closer to the origin of the particle trajectory. In such a case, the apparatus according to the present invention offers the advantage that the parabolic trajectories followed by the droplets results in lower maximum droplet velocities compared to prior art cooling tower methods in which the particles experience free fall conditions.

Not only is the cooling time increased, the relative velocity of droplets to the surrounding atmosphere is also reduced in accordance with the present invention to no greater than approximately 10 meters/second. Lower maximum relative particle velocity improves the spherical shape of the droplets prior to impacting the chill body 11. Further, the lower maximum relative particle velocity reduces the force experienced by the particles upon impact with the chill body 11 and thus the particles that are obtained are only slightly flattened, in contrast to the splats that are obtained using a prior art cooling tower.

Figure 7:
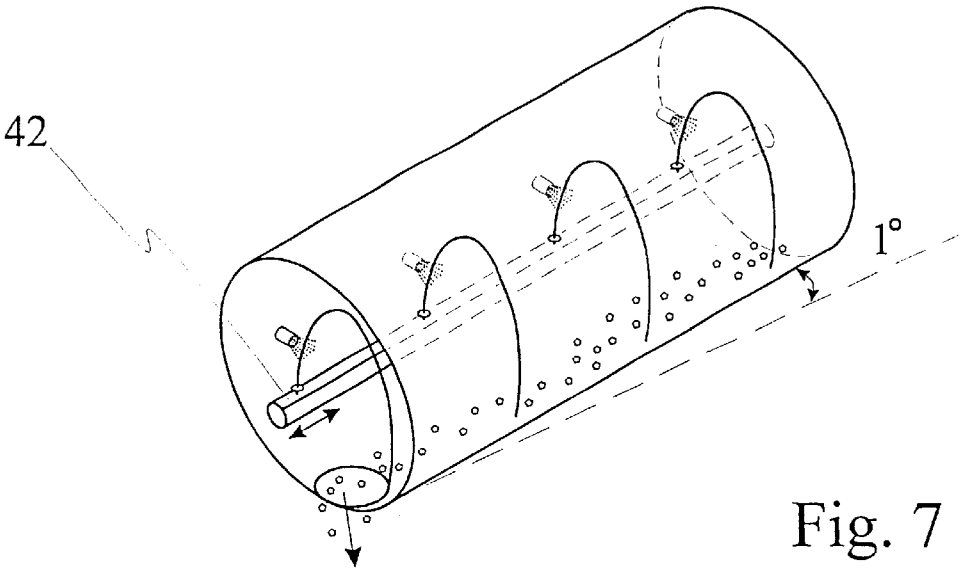
FIG. 7 is a schematic illustration of an alternative embodiment of the present invention including a plurality of nozzles.
Figure 8:
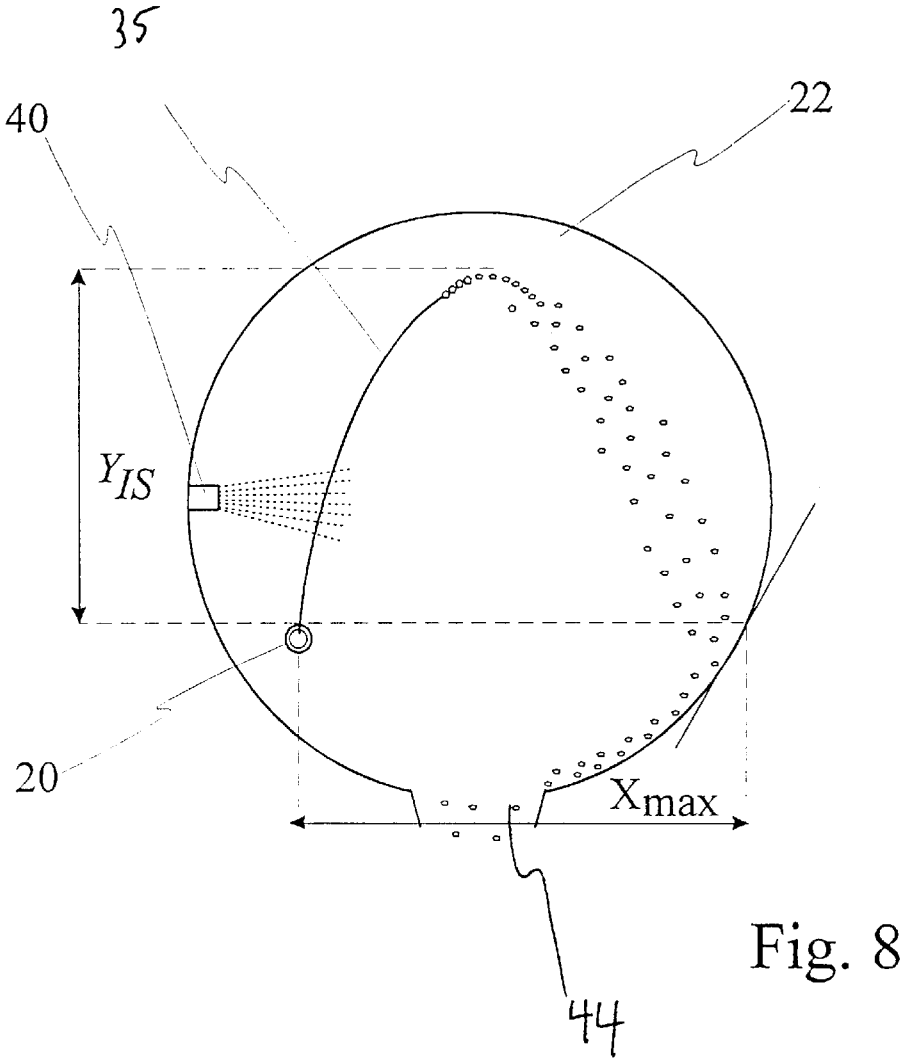
FIG. 8 is an end view of the embodiment illustrated in FIG. 7.

A further embodiment of the invention is illustrated in FIGS. 7 and 8 including a substantially cylindrical elongated cooling chamber 22 containing a plurality of nozzles 20 arranged in parallel from a seamless interconnecting tube 42. An orifice 40 associated with each nozzle 20, releases a cooling plume of argon vapor substantially transversely toward each molten stream. A trajectory 35 is illustrated in FIG. 8. The angle of the nozzle determines the horizontal breadth $X_{max}$ of the trajectory. Pressure in the containment vessel 12 can be adjusted to control the trajectory height $y_{IS}$. The argon plume impacts the molten stream below the trajectory azimuth, as illustrated in FIG. 8. The cooling chamber is maintained at slightly higher than atmospheric pressure. A continuous circulation of argon is maintained to control the temperature within the cooling chamber 22. In addition, the expansion of the argon to gas phase displaces lighter oxygen and nitrogen that might have leaked into the chamber 22. The cooling chamber 22 in this embodiment has a substantially circular cross-section. As a result the trajectories can be directed so that particles impact a lower portion of the chamber at an angle less than perpendicular, which should further reduce the force on impact. Collection of the formed particles and cooling gas evacuation is illustrated through a collection outlet 44.

A cooling plume of atomized nitrogen vapor, helium vapor, carbon dioxide vapor or other liquefied gas could also be used. The plume is injected as a vaporized liquid, which will change to gas entering the elevated temperature of the cooling chamber 22. Depending on the temperature at the plume orifice 40 and the coolant used, the plume may be a vapor plume, a mixture of vapor and gas, or only gas impinging on the molten stream.

A coolant vapor plume also provides a vehicle for introducing other material into the atomization process. For instance the coolant can be mixed with a protective gas, such as sulfur hexafluoride to surround the molten stream and assist in preventing reactions with the molten stream in the cooling chamber atmosphere. Alternatively, a fine solid material, such as powder or whisker material can also be introduced with the coolant plume to combine with the molten material. Ceramic solids such as aluminum oxide, titanium oxide, zirconium oxide or magnesium oxide, silicon nitride or silicon carbide, tungsten carbide, titanium carbide, hafnium carbide or vanadium carbide are used with metals to form composite materials with specific characteristics. By introducing these materials at a controlled rate into the molten stream, particles with more precisely controlled compositions can be formed.

Alternatively, the molten metal may be passed through the feed tube 18 and provided to the aperture 21 of the nozzle 20 at a temperature chosen from a range of temperatures between the liquidus point and the solidus point of the metal alloy, such that the stream of molten metal alloy contains small solid particles of a metal. In the case of a magnesium alloy, for example, the material that solidifies first is more enriched in magnesium than the material that solidifies later. Thus varying the temperature of the stream that is provided to the aperture 21 produces flattened particles of inhomogeneous composition with an induced duplex microstructure.

Further alternatively, once the stream is formed the time of flight of the at least nearly spherical particles in the cooling chamber could be controlled to allow the stream to impact a cold plate while still partially liquid. Such a method would allow the formation of at least nearly spherical particles having a three-dimensional duplex microstructure. Such particles contain grains of varying size having solidified at different rates. In the case of particles composed of an alloy, some grains will be enriched in a first component of the alloy, while other grains are enriched in a second other component of the alloy. In both cases, particles that display such a duplex microstructure are likely to exhibit useful properties when they are partially re-melted. For example, a monometallic particle with a duplex microstructure comprising grains of varying sizes is likely to melt unevenly, with the smaller grains melting before the larger grains, possibly leading to materials with high strength to density ratio.

Numerous other embodiments may be envisaged without departing from the spirit or scope of the invention.

What is claimed is:

1. A method of forming particles of substantially uniform size with an induced duplex microstructure in an atomization apparatus comprising the steps of:

releasing a stream of molten material through an aperture under positive pressure upward into a cooling chamber;

allowing the stream to break up into substantially spherical droplets having a kinetic energy sufficient to follow an upward trajectory above the aperture; and, allowing the droplets to impact a chill body disposed at a predetermined distance from the aperture within a collection area of the cooling chamber, wherein at least one of the positive pressure and the predetermined distance is selected to allow the droplets to cool sufficiently to form a skin that substantially retains the droplet shape during impact at the chill body, and to allow the droplets to remain at least partially molten upon impacting the chill body such that, upon impact, the chill body provides a quenching surface that rapidly cools the at least partially molten droplets and induces a duplex microstructure therein.

2. A method as defined in claim 1, wherein the molten material comprises at least a metal.

3. A method as defined in claim 2, wherein the at least a metal is one of aluminum, magnesium and zinc.

4. A method as defined in claim 2, further including the step of dispersing the trajectories of sequential droplets to reduce the incidence of collisions between droplets.

5. A method as defined in claim 4, further including the step of impinging the upward trajectory of the stream with a flow coolant comprising at least one of a gas coolant and a partially or fully vaporized liquid coolant.

6. A method as defined in claim 5, wherein the coolant includes a fine solid phase material for incorporation with the molten material.

7. A method as defined in claim 5, wherein the coolant comprises a mixture including at least one of a protective gas and a gas for promoting mass transfer.

8. A method as defined in claim 5, wherein the coolant comprises one or more gasses selected from the group consisting of: argon, nitrogen, helium, and carbon dioxide.

9. A method as defined in claim 8, wherein the flow of coolant impinges the upward trajectory of the stream below the azimuth of the trajectory.

10. A method as defined in claim 4, wherein the step of dispersing trajectories comprises applying vibrations to the aperture transverse the direction of the molten stream for causing lateral displacement of the aperture, thereby releasing sequential droplets on differing trajectories.

11. A method as defined in claim 10, wherein the vibrations are for inducing a Rayleigh wave instability to the molten material for breaking up the stream into substantially uniform droplets.

12. A method as defined in claim 1, wherein the upward trajectory includes a descent path comprising at least a portion of a height of the upward trajectory.

13. A method as defined in claim 12, wherein the chill body impinges the descent path of the stream below the azimuth of the trajectory.

14. A method as defined in claim 12, wherein the chill body comprises a metal surface.

15. A method as defined in claim 14, wherein the metal surface comprises a steel plate.

16. A method as defined in claim 15, wherein the chill body is maintained approximately at a constant temperature.

17. A method as defined in claim 1, wherein the chill body impinges the upward trajectory of the stream below the azimuth of the trajectory.

18. A method of forming particles of inhomogeneous chemical composition and of substantially uniform size with an induced duplex microstructure in an atomization apparatus comprising the steps of:

releasing a stream of molten alloy material through an aperture under positive pressure upward into a cooling chamber where the stream breaks up into substantially spherical droplets having a kinetic energy sufficient to follow an upward trajectory above the aperture, the molten alloy material provided to the aperture within a range of temperatures between approximately the liquidus point and the solidus point of the molten alloy material; and, allowing the droplets to impact a chill body disposed within a collection area of the cooling chamber while the droplets are at least partially molten.

19. A method as defined in claim 18, wherein the molten alloy material comprises at least a metal.

20. A method as defined in claim 19, wherein the at least a metal is one of aluminum, magnesium and zinc.

21. A method as defined in claim 19, including the step of dispersing the trajectories of sequential particles to reduce the incidence of collisions between particles.

22. A method as defined in claim 21, including the step of impinging the upward trajectory of the stream with a flow of coolant comprising at least one of a gas coolant and a partially or fully vaporized liquid coolant.

23. A method as defined in claim 22, wherein the coolant comprises a mixture including at least one of a protective gas and a gas for promoting mass transfer.

24. A method as defined in claim 22, wherein the coolant comprises one or more gasses selected from the group consisting of: argon, nitrogen, helium, and carbon dioxide.

25. A method as defined in claim 24, wherein the flow of coolant impinges the upward trajectory of the stream below the azimuth of the trajectory.

26. A method as defined in claim 21, wherein the step of dispersing trajectories comprises applying vibrations to the aperture transverse the direction of the molten stream for causing lateral displacement of the aperture, thereby releasing sequential droplets on differing trajectories.

27. A method as defined in claim 26, wherein the vibrations are for inducing a Rayleigh wave instability to the molten alloy material for breaking up the stream into substantially uniform droplets.

28. A method as defined in claim 18, wherein spherical particles follow their trajectory past the azimuth on a descent path.

29. A method as defined in claim 28, wherein the chill body impinges the upward trajectory of the stream below the azimuth of the trajectory.

30. A method as defined in claim 28, wherein the chill body impinges the descent path of the stream below the azimuth of the trajectory.

31. A method as defined in claim 28, wherein the chill body comprises a metal surface.

32. A method as defined in claim 31, wherein the metal surface comprises a steel plate.

33. A method as defined in claim 32, wherein the chill body is maintained approximately at a constant temperature.

* * * * *